US006286187B1

(12) United States Patent
Chang

(10) Patent No.: US 6,286,187 B1
(45) Date of Patent: Sep. 11, 2001

(54) ROTARY HINGE SHAFT ASSEMBLY

(75) Inventor: Danny Chang, Hsin Chung (TW)

(73) Assignee: Jarlly Technology Co., Ltd., Taipei Hsien (TW)

( * ) Notice: Subject to any disclaimer, the term of this patent is extended or adjusted under 35 U.S.C. 154(b) by 0 days.

(21) Appl. No.: 09/517,753

(22) Filed: Mar. 3, 2000

(51) Int. Cl.[7] ..... E05D 5/10
(52) U.S. Cl. ..... 16/340; 16/386
(58) Field of Search ..... 464/7; 16/340, 16/342, 374, 386; 361/681; 403/309, 310, 311, 313

(56) References Cited

U.S. PATENT DOCUMENTS 763,256 * 6/1904 Burtis ..... 16/386
5,577,847 * 11/1996 Nakamura et al. ..... 384/517
5,774,939 * 7/1998 Lu ..... 16/340 X
5,894,635 * 4/1999 Lu ..... 16/386 X
6,065,187 * 5/2000 Mischenko ..... 16/386 X

* cited by examiner

*Primary Examiner*—Lynne H. Browne
*Assistant Examiner*—Greg Binda
(74) *Attorney, Agent, or Firm*—Dougherty & Troxell

(57) ABSTRACT

A rotary hinge shaft assembly has a movable shaft section, and a stationary shaft section. The movable shaft section is composed of an extending part and a cylinder part with a split groove having a recess ring for receiving a lubricating grease, and an oil groove thereon to communicate with the recess ring for guiding the grease. A collar is between the extending part and the cylinder part. The stationary shaft section has an extending part and a cylindrical shaft with an axial hole to tightly fit with the cylinder part. When the cylinder part is inserted into the axial hole, the split groove is squeezed and slightly distorted to enter the axial hole smoothly. The oil groove offers a complete lubrication such that the friction is reduced and the noise is prevented as the cylinder part rotates with respect to the axial hole.

9 Claims, 4 Drawing Sheets

ROTARY HINGE SHAFT ASSEMBLY

BACKGROUND OF THE INVENTION

1. Field of the Invention

The present invention relates to a rotary hinge shaft assembly, and particularly to such a rotary shaft assembly which has a stationary shaft part engaging a movable shaft part with a tight fit, to simplify and to reduce the assembly time. In addition, an oil groove is provided on the movable shaft to provide sound lubrication such that noise can be avoided.

2. Description of Related Art

Usually, consumer electronic products having a lid such as a portable computer, an electronic dictionary, a portable video-audio playing device, etc. have a lower main body with an upper lid. A rotary hinge shaft links the main body and the lid such that the lid can open and close effectively. Hence, the rotary shaft is one of factors to determine if the above said products are good or not. In fact, an excellent rotary shaft is one which does not become loose under repeated operations. It is necessary also for the rotary shaft to be prevented from generating noise so as to avoid the user having an uncomfortable feeling.

Generally, there are two kinds of ways that friction is generated on a rotation shaft and one of the friction ways is series type, i.e., the axial friction, of which an example has been disclosed in U.S. Pat. No. 5,190,391 (the identical invention was granted as Taiwanese Utility Model No. 73784). Because the present invention is not related to the series type of friction, no further detail will be described. The other of the friction ways is sleeve type, i.e., the radial friction, of which an example has been disclosed in U.S. Pat. No. 5,632,066 (the identical invention was granted as Taiwanese Utility Model No. 111911). In order to acquire an expectant stagnating effect of location, the conventional sleeve type of rotary shaft has to meet a strict requirement of precision. That is, the male connecting member and the female connecting member of the rotary shaft is made of metal being easily ground and cut. In this way, an axial hole can be formed in the female connecting member and a split groove can be formed on a cylinder part at the center of the male connecting member. Then, the cylinder part can be flexibly inserted into the axial hole. After grinding and cutting, the male connecting member and the female connecting member have to be heat-treated so as to increase the strength and durability thereof. However, the cylinder part frequently is distorted through the heat treatment caused by the cylindrical hole. Therefore, it is not possible to properly fit with the axial hole.

SUMMARY OF THE INVENTION

An object of the present invention is to provide a rotary hinge shaft assembly in which a movable shaft and a stationary shaft can be tightly fitted properly to ease the assembling job.

Another object of the present invention is to provide a rotary hinge shalt assembly which has excellent lubrication to avoid unnecessary noise generation.

A further object of the present invention, with which a lid on an article can be opened to a limited angular displacement as desired.

BRIEF DESCRIPTION OF THE DRAWINGS

The present invention can be more fully understood by referring to the following description and accompanying drawing, in which.

DETAILED DESCRIPTION OF THE PREFERRED EMBODIMENTS

Figure 1:
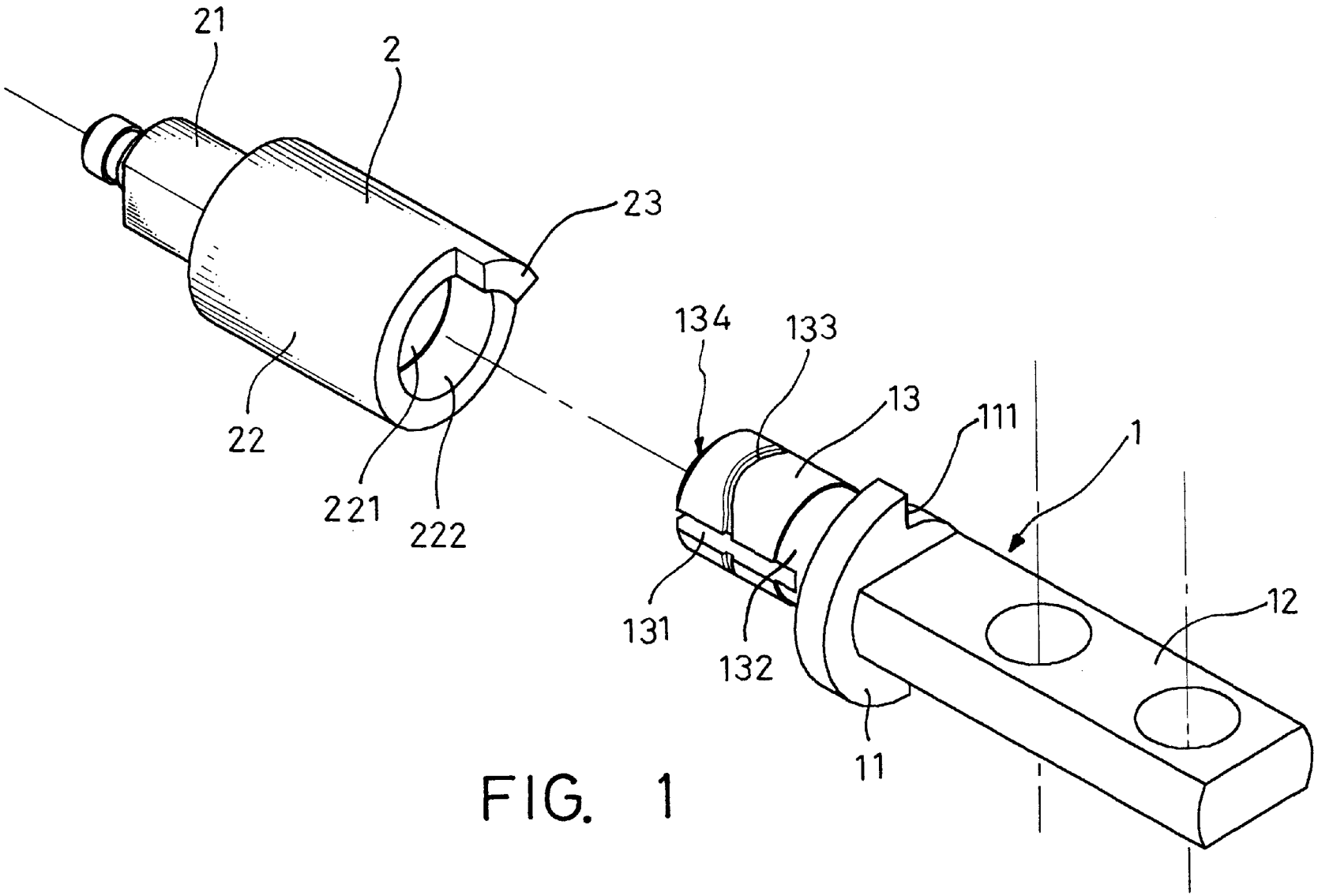
FIG. 1 is a perspective exploded view of a rotary shaft in accordance with the present invention.
Figures 2A, 2B:
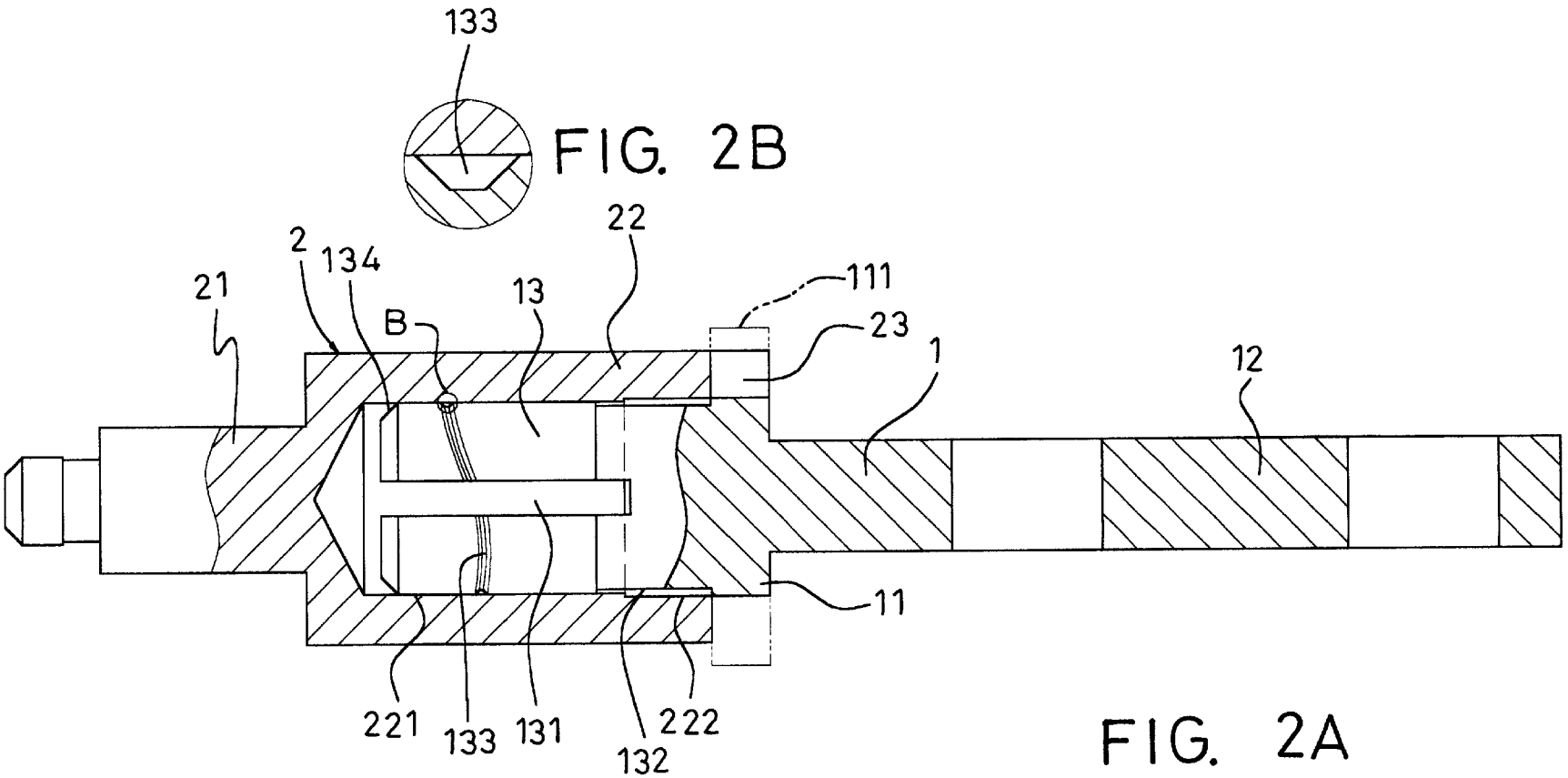
FIG. 2A is a sectional view of the rotary shaft shown in FIG. 1 after assembling.
FIG. 2B is an enlarged view of area B in FIG. 2A.

Referring to FIGS. 1 and 2, basically, a rotary hinge shaft assembly according to the present invention is composed of a movable shaft section 1 and a stationary shaft section 2.

The movable shaft section 1 is an elongated body with a collar 11 extending outward therefrom. An extending part 12 is attached to the collar 11 at a lateral side thereof for engaging with a cover part of an article, such as a screen. A cylinder part 13 is extending outward from another lateral side of the collar 11 and a split groove 131 is provided on the cylinder part 13 extending axially. A recess ring 132 is disposed around the surface of the cylinder part 13 by the collar 11 for receiving the lubricating grease. An oil groove 133 is provided surrounding the surface of the cylinder part 13 to communicate with the recess ring 132 as a guide for the grease. The recess ring 132 cannot only control the friction area of the cylinder part and the stationary shaft part but also guide the grease to the oil groove 133 in case of the grease in the oil groove 133 is out. The cross section of the oil groove 133 is "V" shape with a wider top opening available for receiving more grease. Besides, the free end of the cylinder part 13 has a chamfer 134 to allow the cylinder part 13 to be easily inserted into the stationary shaft part 2.

In order to provide a function of limiting the opening angle for a cover based on client's request, the collar 11 can be cut to form a stop part 111 as desired by the client so as to limit the rotation of the movable shaft section.

The stationary shaft section 2 is a cylindrical body and an end thereof has an extending part 21 to engage with the main body of an article such as a main board. Another end of the stationary shaft section 2 is a cylindrical shaft 22 having an axial hole 221 thereof with a size slightly smaller than that of the cylinder part 13. When the cylinder part 13 is inserted into the axial hole 221, the split groove 131 is squeezed slightly to allow the entire cylinder part 13 to engage the axial hole 221 with a tight fit. Then a rotary shaft with a stagnating effect of location can be formed. In addition, the axial hole 221 at the opening end thereof is provided with an enlarged part 222 and the enlarged part 222 has an inner size a little larger than the outer size of the cylinder part 13 to ease the passing of chamfer 134.

Moreover, the cylindrical shaft 22 at an end thereof a stopper 23 extends outward from the collar 11 to contact the stop part 111 during rotating so as to limit the angular displacement of the movable shaft section 1.

Figure 3:
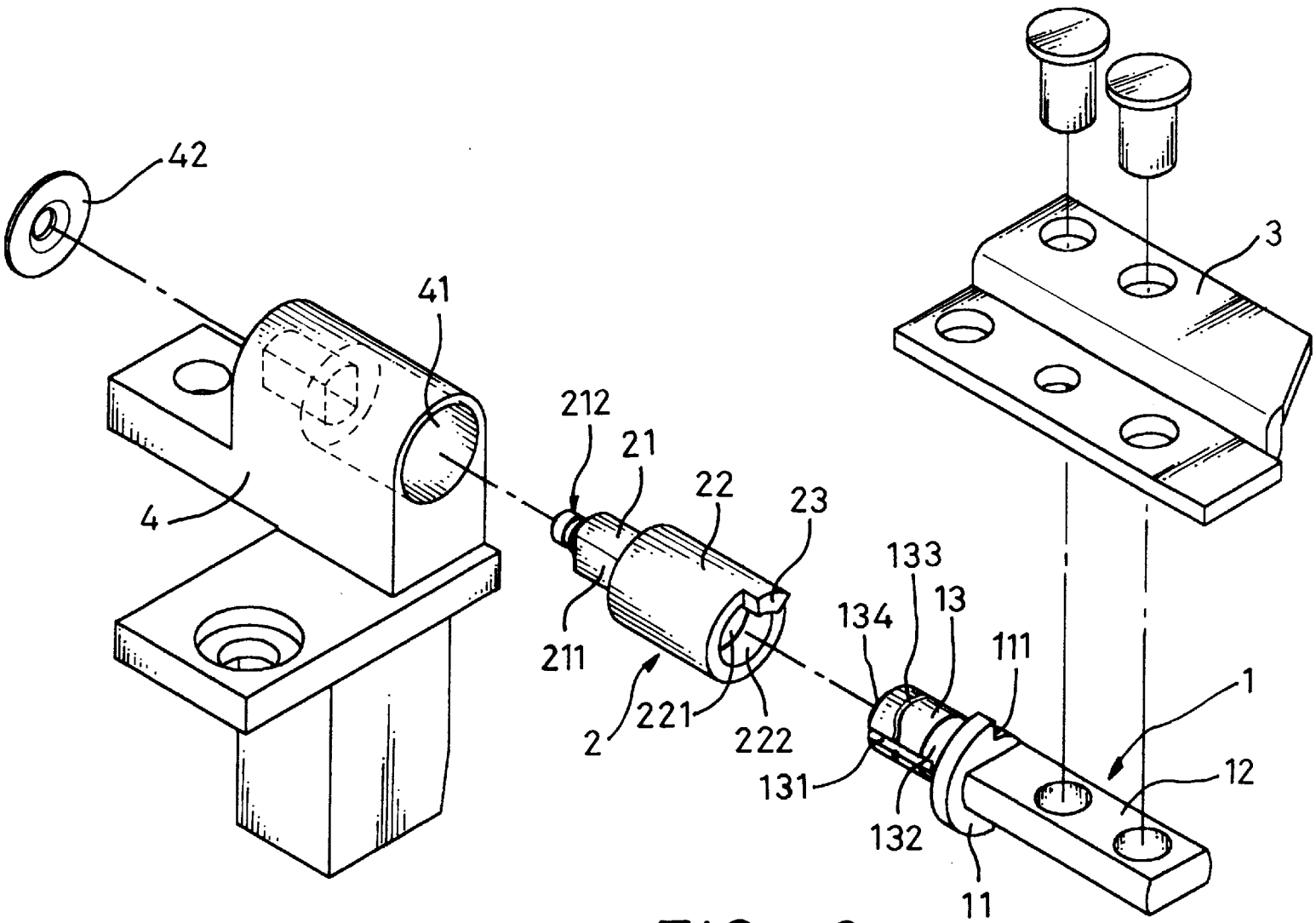
FIG. 3 is a perspective view of the rotary shaft of the present invention with related engaging parts.

Referring to FIG. 3, the rotary shaft shown in FIG. 1 associated with related parts is illustrated. The extending part 12 of the movable shaft section 1 is fastened to a frame 3 attached on the cover part of an article by rivets. The stationary shaft section 2 is inserted into an engaging hole 41 in a support seat 4 and unmovably located therein by way of opposite milled planes 211 on the extending part 21 fitting therewith. A lock head 212 at the free end of the extending part 21 extends out of the seat hole 41 to engage with a lock washer 42 such that the stationary shaft section 2 is fixed to the main body of an article. When the cover part is opened, the friction generated between the cylinder part 13 and the axial hole 221 constitutes a stagnating effect of location. When the stop part 111 touches the stopper 23, a maximum angular displacement of opening the cover part is reached accordingly.

Figure 4:
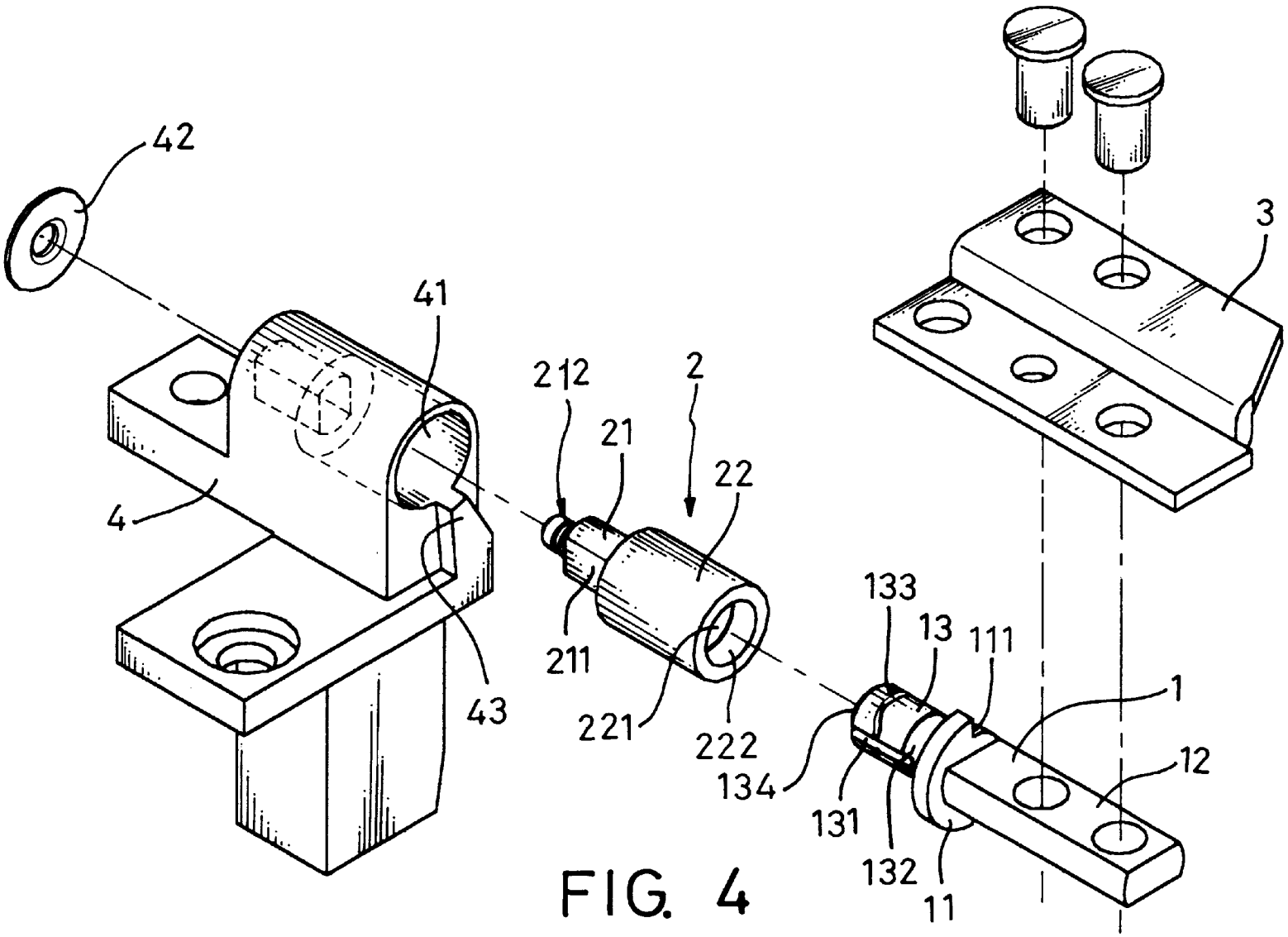
FIG. 4 is a perspective view of the rotary shaft in another embodiment of the present invention.

Referring to FIG. 4, another embodiment of the present invention is illustrated. The embodiment differs with the first embodiment shown in FIG. 3 on that an outward stopper 43 is provided at an end of the support seat 4 extending outward instead of the stopper 23 on the cylindrical shaft 22. When the stop part 111 touches the stopper 43, the maximum angular displacement of the cover part is reached.

It is noted that the preceding described movable shaft section 1 and the stationary shaft section 2 are designations for explanation only. Actually, there is an alternative that the movable shaft section 1 can be provided on the main body of an article and the stationary shaft section 2 can be provided on the cover part of the article to embody the present invention.

It is appreciated that the effectiveness is substantially obtained from the embodiments of the present invention such as the cylinder part merely has a split groove and a distortion caused by the heat treatment can be reduced to a minimum. Furthermore, the recess ring not only adjusts the friction surface on the axial hole to change the friction torque but also offers a storage place of the lubricating grease for the oil groove communicating with the recess ring. The oil groove surrounds the cylinder part by way of screwed thread to provide a complete lubrication so as to avoid the noise generation. Besides, the enlarged hole part at the opening end of the axial hole allows the chamfer at the end of the cylinder part being guided into the hole to avoid a jamming during the assembling job. Moreover, the collar can be cut to form a stop part such that the stop part can interfere with the stopper attached on the cylindrical shaft or with the stopper attached on the support seat to limit the angular displacement of the lid on an article. Additionally, the movable shaft section is available for fitting with either one of the two types of stationary shaft sections such that a production cost can be lower down greatly. Hence, it is conceivable that the present invention is superior to other similar articles in the market.

While the invention has been described with reference to the preferred embodiments thereof, it is to be understood that modifications or variations may be easily made without departing from the spirit of this invention, which is defined by the appended claims.

What is claimed is:

1. A rotary hinge shaft assembly comprising:

a) a stationary shaft section having a cylindrical configuration with a first extending mounting part extending from a first end and an axial hole opening through a second end;

b) a movable shaft section having a projecting collar, a second extending mounting part extending from a first side of the collar, a cylindrical part extending from an opposite side of the collar, the cylindrical part having an axial split groove and a recessed ring located adjacent to the collar, a diameter of the cylindrical part being larger than a diameter of the axial hole, such that the axial split groove enables the cylindrical part to be inserted into the axial hole whereby the movable shaft section is rotatable relative to the stationary shaft section;

c) an oil groove formed in a peripheral surface of the cylindrical part;

d) a stopper extending from the second end of the stationary shaft section; and, e) a stop part formed on the projecting collar and located such that contact with the stopper limits rotation of the movable shaft section.

2. The rotary hinge shaft assembly of claim 1 wherein the oil groove has a V-shaped cross-sectional configuration.

3. The rotary hinge shaft assembly of claim 1 further comprising:

a) a chamfer on an end of cylindrical part of the movable shaft section; and, b) an enlarged diameter portion on the axial hole adjacent to the second end of the stationary shaft section.

4. A rotary hinge shaft assembly comprising:

a) a stationary shaft section having a cylindrical configuration with a first extending mounting part extending from a first end and an axial hole opening through a second end;

b) a movable shaft section having a projecting collar, a second extending mounting part extending from a first side of the collar, a cylindrical part extending from an opposite side of the collar, the cylindrical part having an axial spilt groove and a recessed ring located adjacent to the collar, a diameter of the cylindrical part being larger than a diameter of the axial hole, such that the axial split groove enables the cylindrical part to be inserted into the axial hole whereby the movable shaft section is rotatable relative to the stationary shaft section;

c) an oil groove formed in a peripheral surface of the cylindrical part;

d) a support seat having an engaging hole in which the stationary shaft section is non-rotatable located;

e) a stopper extending outwardly from the support seat; and, f) a stop part formed on the projecting collar and located such that contact with the stopper limits rotation of the movable shaft section.

5. The rotary hinge shaft assembly of claim 4 wherein the oil groove has a V-shaped cross-sectional configuration.

6. The rotary hinge shaft assembly of claim 4 further comprising:

a) a chamfer on an end of cylindrical part of the movable shaft section; and, b) an enlarged diameter portion on the axial hole adjacent to the second end of the stationary shaft section.

7. A rotary hinge shaft assembly comprising:

a) a stationary shaft section having a cylindrical configuration with a first extending mounting part extending from a first end and an axial hole opening through a second end, the first extending mounting part having opposite planar sides and a lock head extending outwardly from an end thereof;

b) a movable shaft section having a projecting collar, a second extending mounting part extending from a first side of the collar, a cylindrical part extending from an opposite side of the collar, the cylindrical part having an axial split groove and a recessed ring located adjacent to the collar, a diameter of the cylindrical part being larger than a diameter of the axial hole, such that the axial split groove enables the cylindrical part to be inserted into the axial hole whereby the movable shaft section is rotatable relative to the stationary shaft section;

c) an oil groove formed in a peripheral surface of the cylindrical part;

d) a support seat having an engaging hole in which the stationary shaft part is non-rotatably located such that a portion of the lock head extends through the engaging hole exteriorly of the support seat; and, e) a locking member engaging the portion of the lock head extending exteriorly of the support seat so as to retain the stationary shaft part therein.

8. The rotary hinge shaft assembly of claim 7 wherein the oil groove has a V-shaped cross-sectional configuration.

9. The rotary hinge shaft assembly of claim 7 further comprising:

a) a chamfer on an end of cylindrical part of the movable shaft section; and, b) an enlarged diameter portion on the axial hole adjacent to the second end of the stationary shaft section.

* * * * *